US009995313B2

(12) United States Patent
Yamashita et al.

(10) Patent No.: US 9,995,313 B2
(45) Date of Patent: Jun. 12, 2018

(54) CEILING FAN BLADE

(71) Applicant: Nidec Corporation, Kyoto (JP)

(72) Inventors: Takamasa Yamashita, Kyoto (JP); Ryosuke Hayamitsu, Kyoto (JP); Toshiyuki Miyashita, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 337 days.

(21) Appl. No.: 14/922,761

(22) Filed: Oct. 26, 2015

(65) Prior Publication Data

US 2016/0115969 A1 Apr. 28, 2016

(30) Foreign Application Priority Data

Oct. 27, 2014 (JP) ..... 2014-217892

(51) Int. Cl.
*F04D 29/38* (2006.01)
*F04D 25/08* (2006.01)
*F04D 19/00* (2006.01)

(52) U.S. Cl.
CPC ..... *F04D 29/384* (2013.01); *F04D 25/088* (2013.01); *F04D 29/388* (2013.01); *F04D 19/002* (2013.01); *F04D 25/08* (2013.01); *F05D 2240/304* (2013.01); *F05D 2250/38* (2013.01)

(58) Field of Classification Search
CPC ..... F04D 29/384; F04D 29/388; F04D 25/08; F04D 25/0889; F04D 19/002
See application file for complete search history.

(56) References Cited

U.S. PATENT DOCUMENTS 1,352,848 A * 9/1920 Stanyo ..... F04D 29/384 416/236 R
4,618,313 A * 10/1986 Mosiewicz ..... B64C 11/18 416/23
5,246,343 A * 9/1993 Windsor ..... F04D 29/325 416/21 OR
6,347,922 B1 * 2/2002 Wang ..... F04D 29/384 415/121.2
7,509,737 B2 * 3/2009 Tai ..... B23P 15/04 29/401.1
9,057,359 B2 * 6/2015 Fuglsang ..... F03D 1/0641
9,638,209 B1 * 5/2017 Cogley ..... F04D 29/388
2004/0009069 A1 1/2004 Bird
2008/0069700 A1 * 3/2008 Laisathit ..... F04D 25/088 416/242

FOREIGN PATENT DOCUMENTS

JP 2003-214390 A 7/2003

* cited by examiner

*Primary Examiner* — Justin Seabe
*Assistant Examiner* — Behnoush Haghighian
(74) *Attorney, Agent, or Firm* — Keating & Bennett, LLP

(57) ABSTRACT

A ceiling fan blade, which is rotated by a motor unit having a center axis extending in an up-down direction, includes a blade body extending in a radial direction and including at least one slit opened at a rotation direction rear edge of the blade body. On a circumferential cross section including a rotation direction front end of the slit of the blade body, a lower end of a rotation direction front edge of the blade body is positioned at a center axis direction upper side of a lower end of the rotation direction front end of the slit. Further, a lower end of an open end of a radial outer edge of the slit is positioned axially downward of the lower end of the rotation direction front end of the slit and is positioned axially upward of a lower end of an open end of a radial inner edge of the slit.

12 Claims, 5 Drawing Sheets

CEILING FAN BLADE

BACKGROUND OF THE INVENTION

1. Field of the Invention

The present invention relates to a ceiling fan blade.

2. Description of the Related Art

A ceiling fan includes blades for generating wind. A ceiling fan blade of the related art is disclosed in, e.g., U.S. Patent Application Publication No. 2004-009069 ("US2004-009069A"). The ceiling fan blade disclosed in US2004-009069A employs a structure in which the collision angle of an air and a blade is continuously reduced from the base of the blade toward the tip thereof. This structure helps improve the energy efficiency of a ceiling fan.

In recent years, a demand has existed for the cost-effective improvement of an air volume of a ceiling fan. In the ceiling fan blade disclosed in US2004-009069A, it is difficult to improve the air volume of the ceiling fan with a low-priced structure.

SUMMARY OF THE INVENTION

In an illustrative preferred embodiment of the present invention, a ceiling fan blade, which is rotated by a motor unit having a center axis extending in an up-down direction, includes a blade body extending in a radial direction and including at least one slit opened at a rotation direction rear edge of the blade body. On a circumferential cross section including a rotation direction front end of the slit of the blade body, a lower end of a rotation direction front edge of the blade body is positioned at a center axis direction upper side of a lower end of the rotation direction front end of the slit. A lower end of an open end of a radial outer edge of the slit is positioned axially downward of the lower end of the rotation direction front end of the slit and is positioned axially upward of a lower end of an open end of a radial inner edge of the slit.

According to an illustrative first invention of the subject application, it is possible to cost-effectively manufacture a ceiling fan blade and to increase an air volume.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Some illustrative preferred embodiments of the present invention will now be described with reference to the accompanying drawings. The scope of the present invention is not limited to the preferred embodiments described below but may be arbitrarily modified without departing from the technical concept of the present invention.

In the following description, unless specifically mentioned otherwise, the direction extending along a center axis J will be referred to an up-down direction. The radius direction extending toward or away from the center axis J will be simply referred to as "radial direction" or "radial". The direction extending circumferentially about the center axis J, i.e., the circumference of the center axis J, will be simply referred to as "circumferential direction" or "circumferential". Furthermore, the direction in which a rotor unit 1A of a motor to be described later rotates will be simply referred to as "rotation direction R".

In the subject specification, the expression "extending in the up-down direction" includes not only a case of extending strictly in the up-down direction but also a case of extending in a direction inclined at an angle of less than 45 degrees with respect to the up-down direction. In the subject specification, the expression "extending in the radial direction" includes not only a case of extending strictly in the radial direction, i.e., in the direction perpendicular to the up-down direction but also a case of extending in a direction inclined at an angle of less than 45 degrees with respect to the radial direction.

Ceiling Fan Blade According to One Preferred Embodiment

Figure 1:
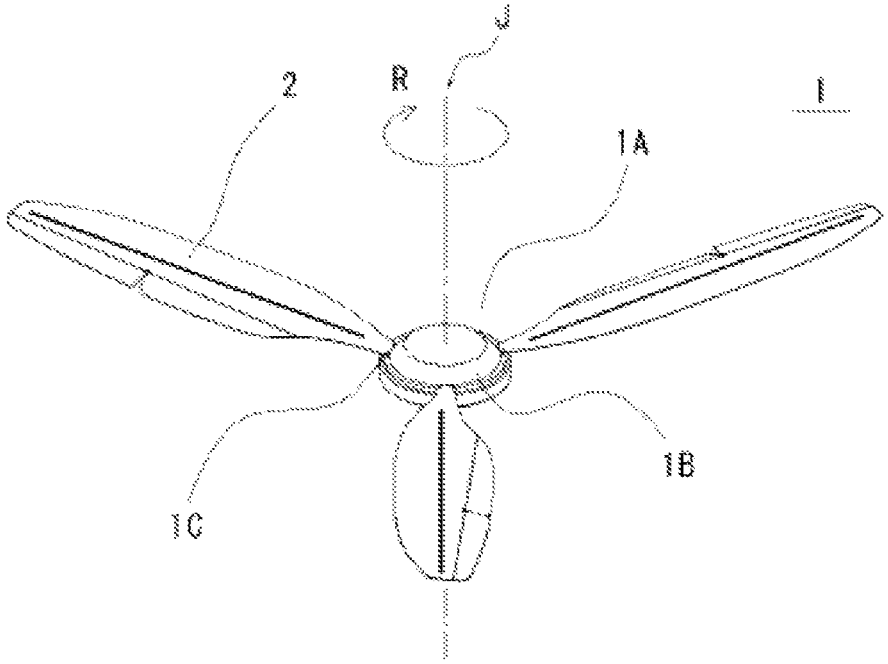
FIG. 1 is a perspective view showing a ceiling fan provided with ceiling fan blades according to one preferred embodiment of the present invention.

FIG. 1 is a perspective view showing ceiling fan blades 2 according to one preferred embodiment of the present invention and a ceiling fan 1 provided with the ceiling fan blades 2. According to the configuration of the present invention, it is possible to cost-effectively manufacture the ceiling fan blades 2 and to increase an air volume.

As shown in FIG. 1, the ceiling fan 1 includes a motor unit 1A and a plurality of blades 2. The motor unit 1A includes a rotor unit 1B which rotates about a center axis J. The blades 2 are connected at connection portions 1C to the rotor unit 1B by, e.g., screw fastening or welding, and are rotated together with the rotor unit 1B about the center axis J. In other words, the ceiling fan blades 2 are rotated by the motor unit 1A having a center axis J extending in the up-down direction.

Figure 2:
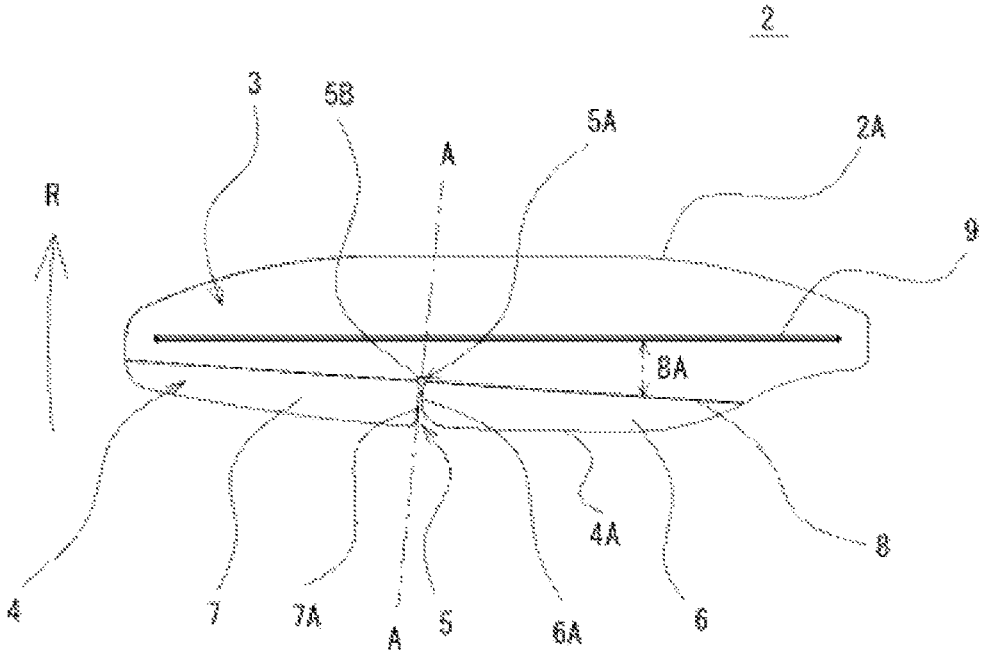
FIG. 2 is a top view of the ceiling fan blade shown in FIG. 1.

FIG. 2 is a top view of one of the blades 2 connected to the rotor unit 1B, which is seen from above in the direction of the center axis. As shown in FIG. 2, the blade 2 includes a blade body 2A extending in the radial direction. The blade body 2A is formed by bending one metal plate at a bending portion 8 which will be described later. Alternatively, the blade body 2A may be formed of a material other than metal.

Referring to FIG. 2, the blade body 2A is integrated with the rotor unit 1B and is rotated in the rotation direction R indicated in FIG. 2. The blade body 2A includes a front region 3 positioned at the front side in the rotation direction R and a rear region 4 positioned at the rear side in the rotation direction R.

The blade body 2A according to the present preferred embodiment includes at least one slit 5 opened at a rotation direction rear edge 4A. The blade body 2A includes a rear region 4 bent downward in the direction of the center axis J with respect to the slit 5. The rear region 4 is divided into a first region 6 positioned radially inward of the slit 5 and a second region 7 positioned radially outward of the slit 5. The radial outer edge of the first region 6 is the radial inner edge 6A of the slit 5. The radial inner edge of the second region 7 is the radial outer edge 7A of the slit 5.

The rotation direction front end 5B of the slit 5 is positioned at the rotation direction rear side of the circumferential width center of the blade body 2A on the circumferential cross section including the rotation direction front end 5B of the slit 5. With this configuration, when the blade body 2A rotates and the air collides with the rear region 4, it is possible to increase the volume of the air blown downward in the center axis direction and to reduce the moment that the blade body 2A receives from the air, the moment acting about the circumferential width center of the blade body 2A.

In the present preferred embodiment, the number of the slit 5 is one. The open end of the slit 5 is positioned radially outward of the radial width center of the blade body 2A in the radial direction. With this configuration, when the air collides with the rear region 4 of the blade body 2A, it is possible to increase the volume of the air blown downward in the center axis direction and to reduce the moment that the blade body 2A receives from the air, the moment acting about the connection portion 1C. The slit 5 need not be necessarily formed radially outward of the radial center of the blade body 2A. The slit 5 may be formed at the radial center of the blade body 2A or radially inward of the radial center of the blade body 2A.

The blade body 2A includes an enlarged portion 5A which is formed at the rotation direction front side of the slit 5 and at which the radial width of the slit 5 becomes larger. With this configuration, it is possible to reduce the resistance that the blade body 2A receives from the air when the air passes through the slit 5.

When seen from above in the center axis direction, the enlarged portion 5A has a substantially circular shape. With this configuration, it is possible to reduce the resistance that the blade body 2A receives from the air and to efficiently distribute the force applied to the vicinity of the enlarged portion 5A of the blade body 2A. The shape of the enlarged portion 5A is not limited to the substantially circular shape but may be a substantially oval shape or a substantially rectangular shape.

As shown in FIG. 2, the front region 3 of the blade body 2A includes a reinforcing portion 9 extending in the radial direction. With this configuration, it is possible to enhance the rigidity of the blade body 2A. Accordingly, even if the slit 5 extending along the circumferential direction is provided in the rear region 4, it is possible to suppress deformation of the blade body 2A in the radial direction.

In the present preferred embodiment, the blade body 2A includes a bending portion 8 including the enlarged portion 5A and extending in the radial direction, at which the blade body 2A is bent. The circumferential gap 8A between the bending portion 8 and the reinforcing portion 9 is formed to gradually increase from the radial outer side toward the radial inner side. With this configuration, it is possible to easily form the blade body 2A and to increase the rigidity of the blade body 2A.

Figure 3:
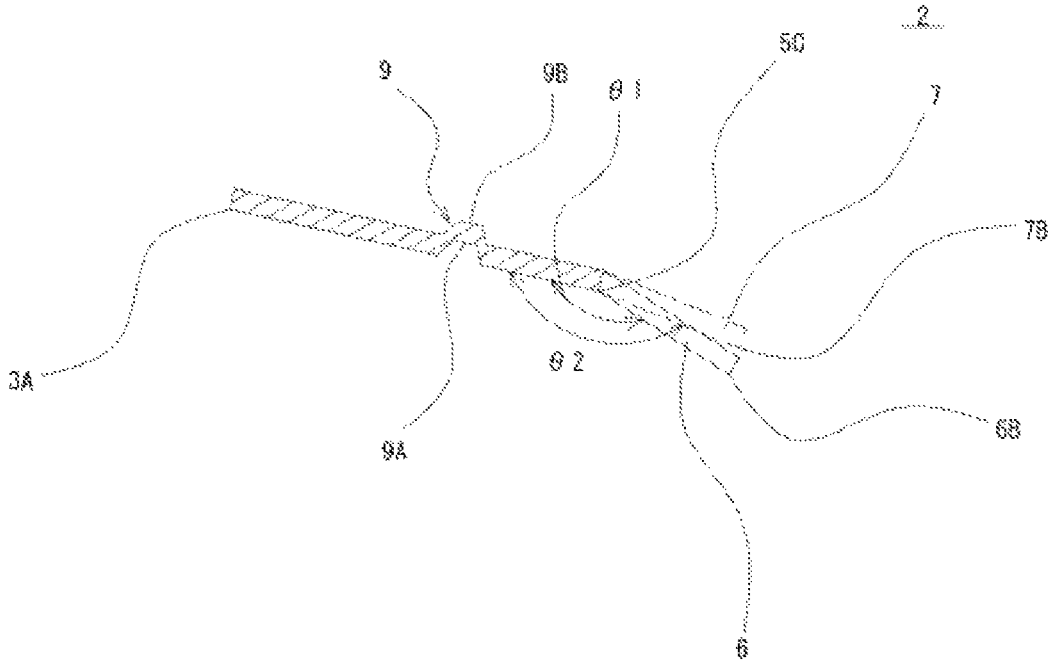
FIG. 3 is a sectional view taken along line A-A in FIG. 2.

FIG. 3 shows a circumferential cross section of the blade body 2A of the present preferred embodiment taken along imaginary line A-A in FIG. 2, in which view the circumferential cross section including the rotation direction front end 5B of the slit 5 is seen from the radial outer side. As shown in FIG. 3, on the circumferential cross section including the rotation direction front end 5B of the slit 5 of the blade body 2A, the lower end of the rotation direction front edge 3A of the blade body 2A is positioned at the center axis direction upper side of the lower end 5C of the rotation direction front end 5B of the slit 5. Furthermore, the lower end 7B of the open end of the radial outer edge 7A of the slit 5 is positioned axially downward of the lower end 5C of the rotation direction front end 5B of the slit 5 and is positioned axially upward of the lower end 6B of the open end of the radial inner edge 6A of the slit 5. With this configuration, it is possible to cost-effectively manufacture the blade body 2A and to increase the air volume.

Furthermore, with this configuration, the portion of the first region 6 near the radial inner edge 6A of the slit 5 on the lower surface of the blade body 2A collides with a larger amount of air during the rotation of the blade body 2A. This makes it possible to increase the volume of the air blown downward in the center axis direction. As compared with the case where the portion of the first region 6 near the radial inner edge 6A of the slit 5 is positioned at the center axis direction upper side of, or at the same height as, the portion of the second region 7 near the radial outer edge 7A of the slit 5, it is possible to reduce the amount of the air colliding with the second region 7 of the blade body 2A. Accordingly, it is possible to increase the air volume generated by the blade body 2A as a whole and to reduce the moment that the second region 7 receives from the air.

The blade body 2A shown in FIG. 3 is formed by bending one metal plate downward in the center axis direction with respect to the slit 5 at the bending portion 8. Furthermore, the lower surface of the first region 6 is positioned axially downward of the lower surface of the front region 3. Accordingly, the lower surfaces of the first region 6 and the second region 7 are substantially flat. The imaginary plane including the first region 6 intersects the imaginary plane including the second region 7 at an angle of greater than 0 degree. In other words, the angle θ1 between the lower surface of the front region 3 and the lower surface of the first region 6 is smaller than 180 degrees and is smaller than the angle θ2 between the lower surface of the front region 3 and the lower surface of the second region 7.

With this configuration, it is possible to cost-effectively manufacture the blade body 2A and to increase the air volume generated by the blade body 2A. In the present preferred embodiment, the second region 7 is formed such that the angle θ2 between the lower surface of the front region 3 and the lower surface of the second region 7 becomes smaller than 180 degrees. However, the angle θ2 need not be necessarily smaller than 180 degrees and may be equal to 180 degrees.

The reinforcing portion 9 is formed by a press work. The lower surface 9A of the reinforcing portion 9 includes a recessed portion. In other words, the lower surface 9A of the reinforcing portion 9 is recessed from the lower surface of the front region 3. With this configuration, as compared with the case where the lower surface of the reinforcing portion 9 is raised from the lower surface of the front region 3, it is possible to improve the air blowing efficiency of the blade body 2A. The reason is as follows. If the lower surface of the reinforcing portion 9 is formed of a raised portion, when the blade body 2A makes rotation, the air collides with the raised portion on the lower surface of the blade body 2A, whereby a turbulent flow of the air is generated at the rotation direction rear side of the raised portion. In contrast, when the lower surface of the reinforcing portion 9 has a recessed portion, as compared with the case where the lower surface of the reinforcing portion 9 has the raised portion, it is possible to suppress generation of a turbulent flow at the rotation direction rear side of the recessed portion. Furthermore, in the present preferred embodiment, the upper surface 9B of the reinforcing portion 9 is raised from the upper surface of the front region 3.

2. Ceiling Fan Blade According to Another Preferred Embodiment

Figure 4:
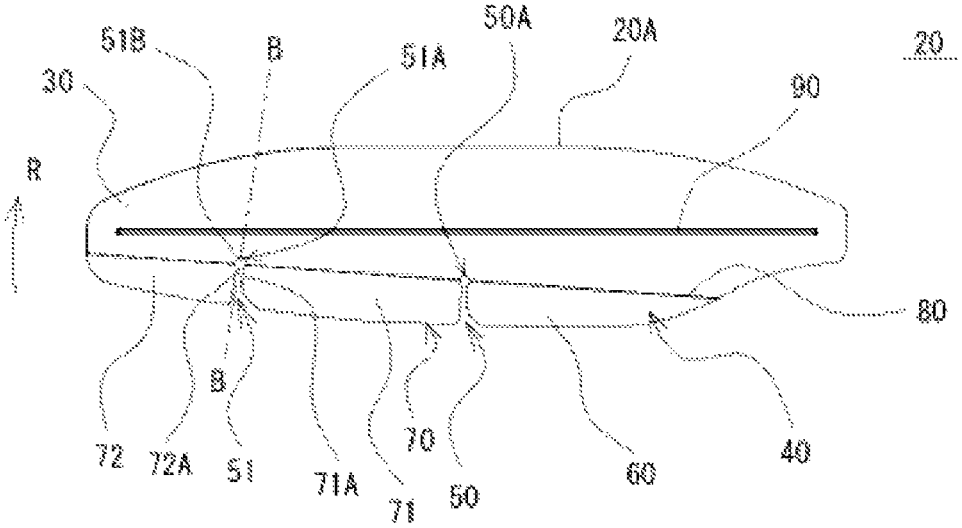
FIG. 4 is a top view showing a ceiling fan blade according to another preferred embodiment of the present invention.

FIG. 4 is a top view of a ceiling fan blade 20 according to another preferred embodiment of the present invention. The configuration of the blade body 20A of the blade 20 according to the present preferred embodiment corresponds to the configuration of the blade body 2A described with reference to FIG. 2 within the extent that no technical and structural conflict arises. As for the points at which the structures and the technical contents are self-evident from the correspondence of both configurations, it is possible to appropriately read the corresponding parts. The blade body 20A rotates in the rotation direction R indicated in FIG. 4. The blade body 20A includes a front region 30 positioned at the rotation direction front side and a rear region 40 positioned at the rotation direction rear side. The blade body 20A includes a first slit 50 opened at the rotation direction rear edge 40A of the rear region 40. The blade body 20A is divided by the first slit 50 into a first region 60 positioned at the radial inner side and a second region 70 positioned at the radial outer side.

The blades 2 further includes, in addition to the first slit 50, a second slit 51 opened at the rotation direction rear edge 40A of the second region 70. In other words, the blade body 20A further includes the second slit 51 positioned radially outward of the first slit 50 and opened at the rotation direction rear edge 40A. The rear region 40 is divided by the second slit 51 into a second inner region 71 positioned radially outward of the first slit 50 and radially inward of the second slit 51 and a second outer region 72 positioned radially outward of the second slit 51. The radial outer edge of the second inner region 71 is the radial inner edge 71A of the second slit 51. The radial inner edge of the second outer region 72 is the radial outer edge 72A of the second slit 51.

The rotation direction front portion of the second slit 51 includes an enlarged portion 51A at which the radial width of the second slit 51 becomes larger and a rotation direction front end 51B. In the present preferred embodiment, the enlarged portion 51A has a substantially circular shape when seen from above in the center axis direction. However, the shape of the enlarged portion 51A need not be necessarily a substantially circular shape but may be other shapes.

In the present preferred embodiment, the blade body 20A is formed by bending one metal plate at a bending portion 80. The bending portion 80 is formed to extend along an imaginary straight line which interconnects the enlarged portion 50A positioned at the rotation direction front side of the first slit 50 and the enlarged portion 51A of the second slit 51. The blade body 20A further includes a reinforcing portion 90 positioned in the front region 30.

Figure 5:
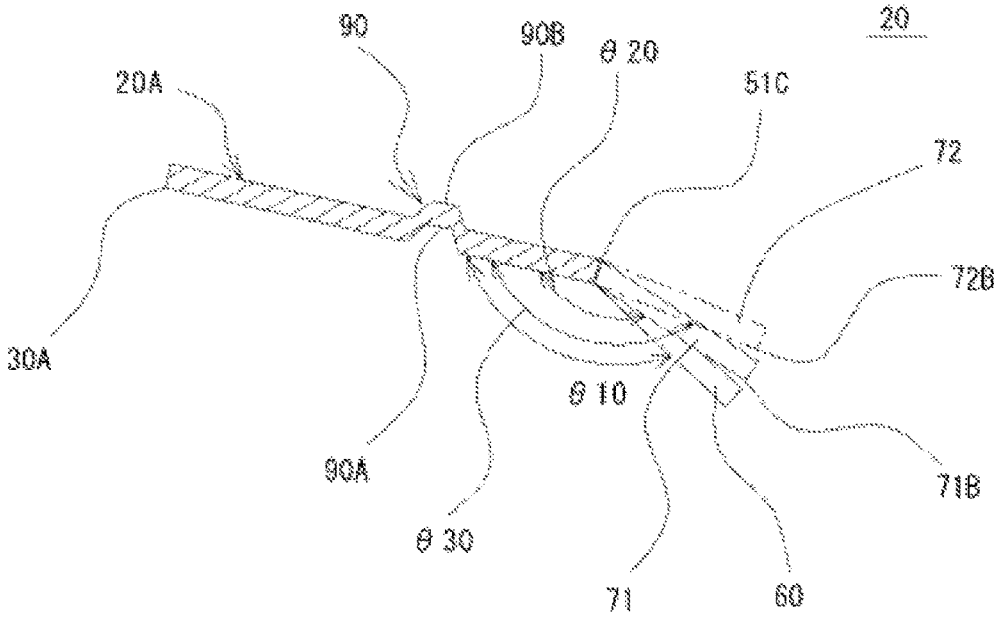
FIG. 5 is a sectional view taken along line B-B in FIG. 4.

FIG. 5 shows a circumferential cross section of the blade body 20A of the present preferred embodiment taken along imaginary line B-B in FIG. 4, in which view the circumferential cross section including the rotation direction front end 51B of the second slit 51 is seen from the radial outer side. As shown in FIG. 5, on the circumferential cross section including the rotation direction front end 51B of the second slit 51 of the blade body 20A, the lower end 30A of the rotation direction front edge of the blade body 20A is positioned at the rotation direction upper side of the lower end 51C of the rotation direction front end of the second slit 51.

Furthermore, the lower end 72B of the open end of the radial outer edge 72A of the second slit 51 is positioned axially downward of the lower end 51C of the rotation direction front end of the second slit 51 and is positioned axially upward of the lower end 71B of the open end of the radial inner edge 71A of the second slit 51. With this configuration, it is possible to cost-effectively manufacture the blade body 20A and to increase the air volume. In other words, the portion of the second inner region 71 near the radial inner edge 71A of the second slit 51 on the lower surface of the blade body 20A collides with a large amount of air during the rotation of the blade body 20A. This makes it possible to increase the volume of the air blown downward in the center axis direction. As compared with the case where the portion of the second inner region 71 near the radial inner edge 71A of the second slit 51 is positioned at the center axis direction upper side of, or at the same height as, the portion of the second outer region 72 near the radial outer edge 72A of the second slit 51, it is possible to reduce the amount of the air colliding with the second outer region 72 of the blade body 20A. Accordingly, it is possible to increase the air volume generated by the blade body 20A as a whole and to reduce the moment that the second outer region 72 receives from the air, the moment acting about the radial inner end of the blade body 20A.

In the present invention, the blade body 20A is formed by bending one metal plate at the bending portion 80. Accordingly, the lower surface of the second inner region 71 and the lower surface of the second outer region 72 are substantially flat. The imaginary plane including the second inner region 71 intersects the imaginary plane including the second outer region 72 at an angle of greater than 0 degree. In other words, the angle θ20 between the lower surface of the front region 30 of the blade body 20A and the lower surface of the second inner region 71 is smaller than 180 degrees and is smaller than the angle θ30 between the lower surface of the front region 30 and the lower surface of the second outer region 72. With this configuration, it is possible to cost-effectively manufacture the blade body 20A and to increase the air volume generated by the blade body 20A. In addition, it is possible to reduce the moment that the second outer region 72 receives from the air, the moment acting about the radial inner end of the blade body 20A.

In the present preferred embodiment, the angle θ30 between the lower surface of the front region 30 and the lower surface of the second outer region 72 is smaller than 180 degrees. However, the angle θ30 need not be necessarily smaller than 180 degrees and may be equal to 180 degrees. In the preferred embodiments described above, there has been described the case where the number of the slit is one or two. However, there may be formed more than two slits.

The present invention may be used in, e.g., the ceiling fan.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A ceiling fan blade rotated by a motor unit having a center axis extending in an up-down direction, comprising:

a blade body extending in a radial direction and including a first slit opened at a rear edge of the blade body in a rotation direction, wherein on a circumferential cross section including a front end of the first slit of the blade body in the rotation direction, a lower end of a front edge of the blade body in the rotation direction is positioned at an upper side of a lower end of the front end of the first slit in the up-down direction, and a lower end of an open end of a radial outer edge of the first slit is positioned axially downward from the lower end of the front end of the first slit and is positioned axially upward from a lower end of an open end of a radial inner edge of the first slit.

2. The blade of claim 1, wherein the front end of the first slit is positioned at a rear side of a circumferential center of a width of the blade body on the circumferential cross section.

3. The blade of claim 1, wherein the open end of the first slit is positioned radially outward of a center of a radial width of the blade body in the radial direction.

4. The blade of claim 1, wherein the first slit includes an enlarged portion which is at the front end of the first slit and at which a radial width of the first slit increases.

5. The blade of claim 4, wherein the enlarged portion has a substantially circular shape when seen from above in a center axis direction.

6. The blade of claim 1, wherein the blade body includes a rear region bent downward in a center axis direction with respect to the first slit, the rear region is divided into a first region positioned radially inward of the first slit and a second region positioned radially outward of the first slit, a lower surface of the first region and a lower surface of the second region are substantially flat, and an imaginary plane including the first region intersects an imaginary plane including the second region at an angle of greater than 0 degree.

7. The blade of claim 1, wherein the blade body further includes a second slit positioned radially outward of the first slit and opened at the rotation direction rear edge of the blade body;

on a circumferential cross section including a rotation direction front end of the second slit of the blade body, the lower end of the rotation direction front edge of the blade body is positioned above a lower end of the front end of the second slit in the up-down direction; and a lower end of an open end of a radial outer edge of the second slit is positioned below the lower end of the front end of the second slit in the up-down direction and is positioned above a lower end of an open end of a radial inner edge of the second slit.

8. The blade of claim 7, wherein the blade body includes a rear region positioned at a rear side of the blade body in the rotation direction, the rear region is divided by the second slit into a second inner region positioned radially outward of the first slit and radially inward of the second slit and a second outer region positioned radially outward of the second slit, a lower surface of the second inner region and a lower surface of the second outer region are substantially flat, and an imaginary plane including the second inner region intersects an imaginary plane including the second outer region at an angle of greater than 0 degree.

9. The blade of claim 1, wherein the blade body includes a front region positioned at a front side of the blade body in the rotation direction, the front region including a reinforcing portion extending in the radial direction.

10. The blade of claim 9, wherein the blade body includes an enlarged portion which is provided at the front end of the first slit and at which a radial width of the first slit increases, the blade body includes a bending portion including the enlarged portion and extending in the radial direction, the blade body bent at the bending portion, and a circumferential gap between the bending portion and the reinforcing portion increases from a radial outer side toward a radial inner side.

11. The blade of claim 9, wherein the reinforcing portion is formed by press working, the reinforcing portion including a recessed portion provided on a lower surface thereof.

12. A ceiling fan comprising the ceiling fan blade of claim 1.

* * * * *